US007350546B2

(12) United States Patent
Stavrakis et al.

(10) Patent No.: US 7,350,546 B2
(45) Date of Patent: Apr. 1, 2008

(54) FILLING VALVE APPARATUS HAVING A QUICK CONNECT/RELEASE MECHANISM

(75) Inventors: Demetrios Stavrakis, Booklandville, MD (US); Edwin K. Ruble, Baltimore, MD (US); Michael J. Brown, Baltimore, MD (US)

(73) Assignee: ADCOR Industries, Inc., Baltimore, MD (US)

( * ) Notice: Subject to any disclaimer, the term of this patent is extended or adjusted under 35 U.S.C. 154(b) by 414 days.

(21) Appl. No.: 10/985,196

(22) Filed: Nov. 10, 2004

(65) Prior Publication Data

US 2005/0098230 A1 May 12, 2005

Related U.S. Application Data

(60) Provisional application No. 60/549,129, filed on Mar. 1, 2004, provisional application No. 60/518,777, filed on Nov. 10, 2003.

(51) Int. Cl.
*B65B 1/04* (2006.01)

(52) U.S. Cl. ..... 141/386; 141/90; 141/98; 141/392; 222/567

(58) Field of Classification Search ..... 141/2, 141/18, 90, 98, 144–147, 383–386, 392; 222/567; 411/34, 349; 403/408.1
See application file for complete search history.

(56) References Cited

U.S. PATENT DOCUMENTS

| | | | | | |
|---|---|---|---|---|---|
| 744,271 | A | | 11/1903 | Adams | |
| 1,061,662 | A | | 5/1913 | Crandall | |
| 1,154,056 | A | | 9/1915 | Reid | |
| 1,627,778 | A | | 5/1927 | Hutchinson | |
| 1,858,595 | A | | 5/1932 | Parker et al. | |
| 2,707,413 | A | | 5/1955 | Goodnow | 81/61 |
| 2,913,016 | A | * | 11/1959 | Luther | 141/7 |
| 3,175,591 | A | | 3/1965 | Manas | 141/295 |
| 3,176,731 | A | | 4/1965 | Minard | 141/295 |
| 3,179,455 | A | * | 4/1965 | Blair | 292/65 |
| 3,289,712 | A | | 12/1966 | Smith | 141/295 |
| 3,756,290 | A | | 9/1973 | Cleland et al. | 141/5 |
| D255,772 | S | * | 7/1980 | Johnson et al. | D8/331 |
| 4,700,756 | A | * | 10/1987 | Minard | 141/144 |
| 4,755,092 | A | * | 7/1988 | Yaniv | 411/554 |
| 4,893,733 | A | | 1/1990 | Thomsen | 141/313 |
| 5,586,589 | A | * | 12/1996 | Voelker | 141/349 |
| 5,740,844 | A | | 4/1998 | Miller | 141/90 |
| 5,975,159 | A | | 11/1999 | Persenaire et al. | 141/145 |
| 6,253,811 | B1 | | 7/2001 | Slagh | 141/383 |

* cited by examiner

*Primary Examiner*—Timothy L. Maust
(74) *Attorney, Agent, or Firm*—Howard & Howard Attorneys, P.C.

(57) ABSTRACT

A filling valve apparatus having a flange for mounting to a beverage filling machine. A shank extends through the flange and is mounted to the beverage filling machine. A locking device is coupled to the shank with the locking device having an unlocked position loosely connected to the shank and a locked position with at least a portion of the locking device wedged between the flange and the shank for fixedly securing the filling valve apparatus to the beverage filling machine. The subject invention also includes a servicing kit for servicing the filling valve apparatus. The servicing kit includes the shank, the locking device, and a wrench assembly as well as other components.

17 Claims, 6 Drawing Sheets

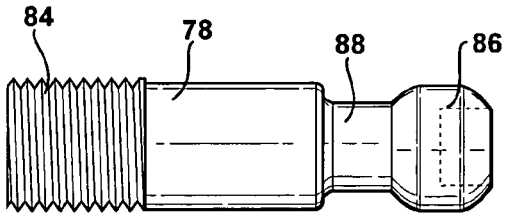
FIG - 2
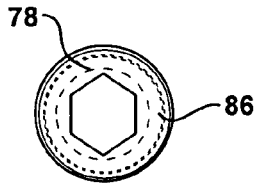
FIG - 3
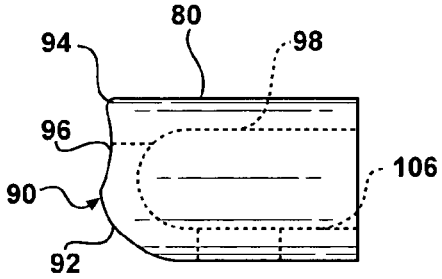
FIG - 4
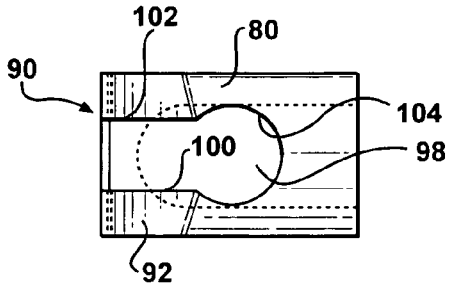
FIG - 5
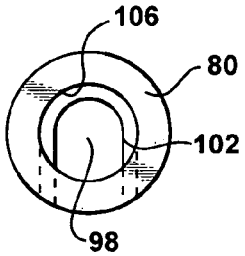
FIG - 6
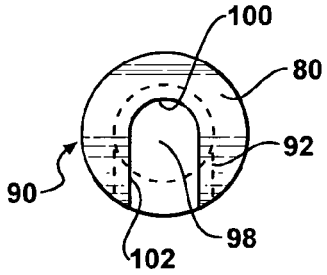
FIG - 7
FIG - 8
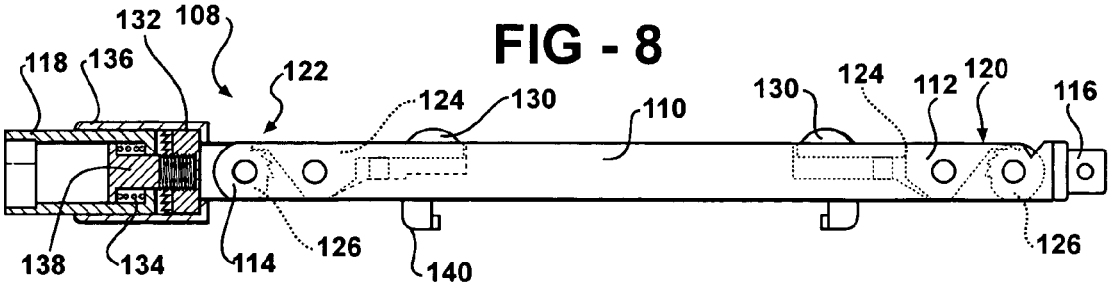

FILLING VALVE APPARATUS HAVING A QUICK CONNECT/RELEASE MECHANISM

CROSS-REFERENCE TO RELATED APPLICATIONS

The subject patent application claims priority to and all the benefits of U.S. Provisional Patent Application Ser. No. 60/518,777, which was filed on Nov. 10, 2003 and U.S. Provisional Patent Application Ser. No. 60/549,129, which was filed on Mar. 1, 2004.

BACKGROUND OF THE INVENTION

1. Field of the Invention

The subject invention relates to filling valve apparatuses for beverage filling machines and a mechanism for mounting the filling valve apparatus to the beverage filling machine.

2. Description of Related Art

Beverage filling machines typically include, based on size, 40, 60, 72, 100, 120, or 130 filling valve apparatuses. Each of these filling valves progressively fill a container, such as a can or bottle, with a liquid, such as water, soda, or beer. The filling valves are also used when cleaning the beverage filling machine. Typical filling valve apparatuses are shown in U.S. Pat. Nos. 4,750,533; 4,979,546; 5,944,072; and 6,076,567.

The filling valve apparatuses are typically bolted to the beverage filling machines and include a number of working components. Through repeated cycling of the filling valves, the components have a tendency to wear and must be serviced at regular intervals, such as every 1.5 million cycles. The servicing of each of the filling valves is a time consuming and expensive process. To service the filling valves, each of the filling valves must be removed from the beverage filling machine by removing a nut from a stud extending from the beverage filling machine. Taking into consideration the large number of individual filling valves, such as 72, 100, or 130 filling valves, the removal of the nuts can be a difficult and cumbersome process that can lead to lengthy down times in the operation of the beverage filling machine.

The prior art has contemplated alternative methods to mounting the filling valves to the beverage filling machines. One such alternative is shown in U.S. Pat. No. 4,700,756 and another alternative is shown in U.S. Pat. No. 5,975,159. The designs shown in the '756 and '159 patents, however, have a number of deficiencies. One deficiency is that these designs will wear over time and be less effective in holding the filling valve apparatuses in a proper position, which will lead to leaks, misalignments, etc. Also, these designs, especially the design shown in the '159 patent, will not provide an adequate clamping force against the filling valve apparatuses to ensure proper positioning is maintained during operation of the beverage filling machine.

Accordingly, it would be desirable to develop a filling valve apparatus that is adequately retained to the beverage filling machine and can be easily and efficiently removed from the beverage filling machine while avoiding the deficiencies of the prior art.

SUMMARY OF THE INVENTION AND ADVANTAGES

The subject invention includes a filling valve apparatus of a beverage filling machine for filling a container with a fluid. The filling valve apparatus comprises a body portion having a flange with at least one opening disposed within the flange. The body portion defines a cavity with at least one aperture for directing the fluid into the container. A shank extends through the opening in the body portion and is adapted to be mounted to the beverage filling machine. A locking device is coupled to the shank with the locking device having an unlocked position loosely connected to the shank and a locked position with at least a portion of the locking device wedged between the flange and the shank for fixedly securing the filling valve apparatus to the beverage filling machine.

The subject invention also includes a servicing kit for servicing the filling valve apparatus. The servicing kit includes the shank adapted to be mounted to the beverage filling machine. The shank has a distal end adapted to extend through a portion of the filling valve apparatus with a ball disposed at the distal end. The locking device has a cavity and a first opening providing access to the cavity with the ball disposed within the cavity and the shank extending through the first opening when the locking device is coupled to the shank wherein the locking device has an unlocked position loosely connected to the shank and a locked position with at least a portion of the locking device wedged between the flange and the shank for fixedly securing the filling valve apparatus to the beverage filling machine. The servicing kit also includes a wrench assembly having a first end engaging the locking device to move the locking device between the unlocked and locked positions and for removing the filling valve apparatus from the beverage filling machine and re-installing the filling valve apparatus onto the beverage filling machine when the beverage filling machine is serviced.

The shank and locking device define a quick connect/release mechanism for quickly and efficiently removing and re-installing the filling valve apparatus onto the beverage filling machine. The subject invention also provides for a complete servicing kit which includes the quick connect/release mechanism and a wrench for manipulating the quick connect/release mechanism.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2 is a side view of a shank;

FIG. 3 is an end view of the shank;

FIG. 4 is a side view of a locking device;

FIG. 5 is another side view of the locking device;

FIG. 6 is a top view of the locking device;

FIG. 7 is a bottom view of the locking device;

FIG. 8 is a side view of a wrench assembly;

DETAILED DESCRIPTION OF THE INVENTION

Figure 1:
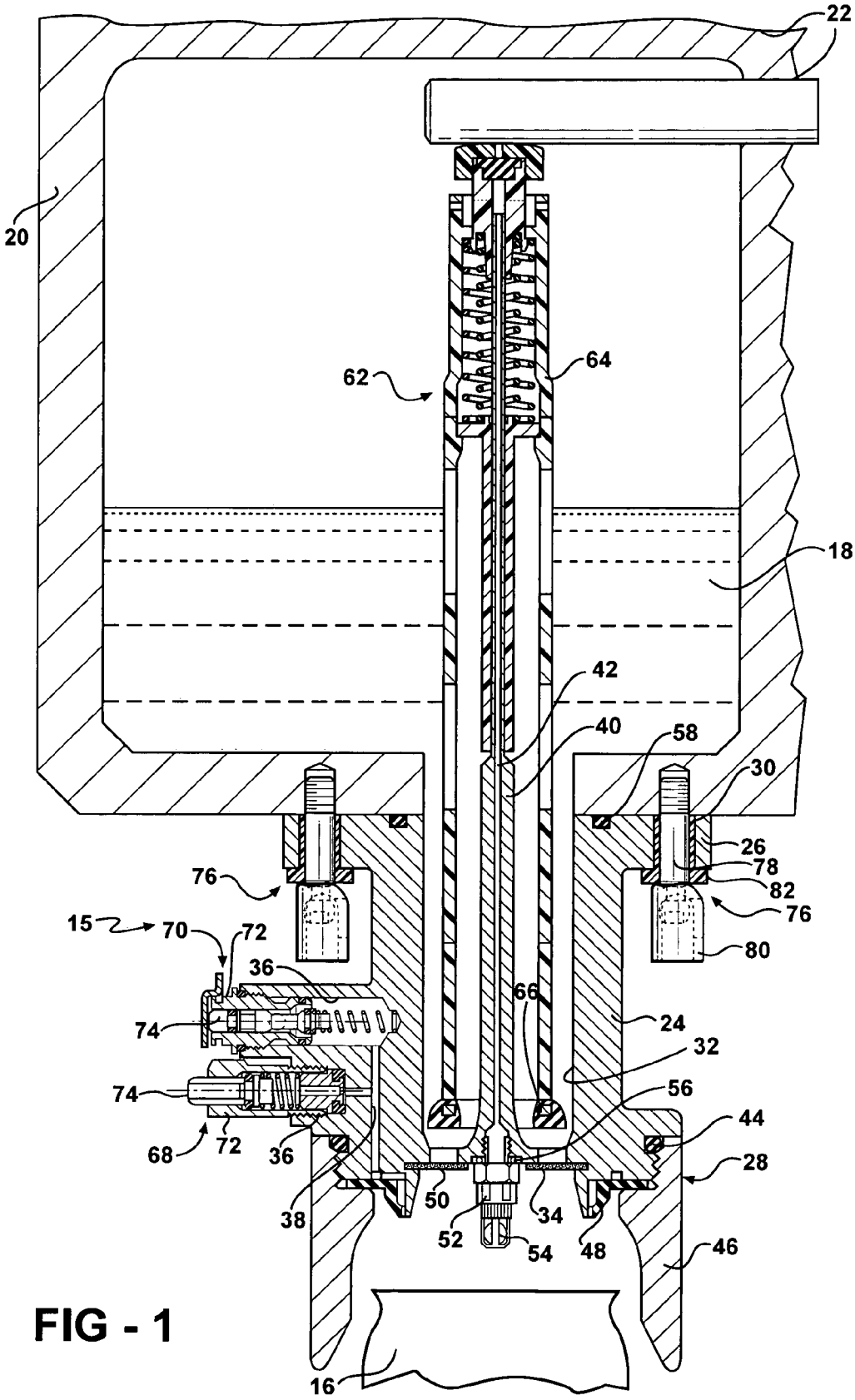
FIG. 1 is a partially cross-sectional view of a filling valve apparatus connected to a beverage filling machine.

Referring to the Figures, wherein like numerals indicate like or corresponding parts throughout the several views, a filling valve apparatus 15 for filling a container 16 with a fluid 18 is shown in FIG. 1. The filling valve apparatus 15 is connected to a tank 20 of a beverage filling machine 22. As discussed in the background section above, there are typically 40, 60, 72, 100, 120, or 130 filling valve apparatuses on any one beverage filling machine. Each of the filling valve apparatuses 15 are substantially identical such that only one filling valve apparatus 15 will be discussed in any greater detail below. The tank 20 and other associated components of the beverage filling machine 22 do not form part of the claimed invention and will therefore not be discussed in any detail. It should be appreciated that the tank 20 and beverage filling machine 22 may be of any suitable design or configuration.

The filling valve apparatus 15 includes a body portion 24 having a flange 26 at one end, which abuts the beverage filling machine 22, and a threaded section 28 at an opposing end. The flange 26 has at least one opening 30 disposed therein. Preferably, there are a pair of annular openings 30 disposed within opposing sides of the flange 26. The body portion 24 defines a cavity 32 with at least one aperture 34 for directing the fluid 18 into the container 16. The body portion 24 also includes a pair of integral bores 36 and a common passageway 38 extending from the bores 36.

A stem 40 is mounted to the body portion 24 within the cavity 32. The stem 40 defines a longitudinal passageway 42 extending out of the body portion 24. A ring seal 44 is disposed about the threaded section 28 and a valve bell 46 is threadingly connected to the threaded section 28. A container seal 48 is wedged between the body portion 24 and the valve bell 46. A screen 50 and a ball cage 52 are also connected to the body portion 24. A ball 54 is disposed within the ball cage 52 and a small seal 56 is disposed between the ball cage 52 and the body portion 24. At least one additional seal 58 is disposed in the flange 26 to seal the cavity 32 and passageway 38, respectively. The configuration and operation of the stem 40, valve bell 46, container seal 48, screen 50, and ball cage 52 are well known to those skilled in the art and will therefore not be discussed in any greater detail.

The filling valve apparatus 15 also includes a cartridge assembly 62. The cartridge assembly 62 in turn includes an elongated sleeve 64 disposed over the stem 40 with the sleeve 64 being removable from the stem 40 and the body portion 24 when the filling valve apparatus 15 is serviced. In fact, the entire cartridge assembly 62 is removed from the stem 40 as a single unit when the filling valve apparatus 15 is serviced. The sleeve 64 has a top and a bottom with the bottom extending into the cavity 32 of the body portion 24. A seal 66 is mounted to the bottom of the sleeve 64 for sealing the aperture 34 of the body portion 24 and preventing fluid 18 from flowing through the aperture 34 of the body portion 24.

The filling valve apparatus 15 also includes at least one valve assembly 68, 70. In the embodiment illustrated, there are a pair of valve assemblies 68, 70, which are known in the art as a snift valve assembly 68 and a purge valve assembly 70. The snift valve assembly 68 is used during the normal operation of the filling valve apparatus 15 and the purge valve assembly 70 is used during a cleaning operation of the filling valve apparatus 15. Each of the snift 68 and purge 70 valve assembles include a housing 72 disposed within an associated bore 36 of the body portion 24. A movable plunger 74 is disposed within the housing 72 for selectively allowing fluid 18 to flow through the passageway 38 in the body portion 24. It should be appreciated that the purge valve assembly 70 could be eliminated from the filling valve apparatus 15 without deviating from the overall scope of the subject invention. As with the cartridge assembly 62 discussed above, the valve assemblies 68, 70 are removable from the body portion 24 as a unitary item when the filling valve apparatus 15 is serviced, which further increases the efficiency of the servicing process.

The unitary cartridge assembly 62 and unitary valve assemblies 68, 70 are disclosed and claimed in co-pending U.S. patent application Ser. No. 10/985,168, which is herein incorporated by reference. As such, these components will not be discussed in any greater detail.

Referring now to FIGS. 1-7, the filling valve apparatus 15 includes a quick connect/release mechanism 76 for efficiently connecting and disconnecting the filling valve apparatus 15 to the tank 20. The quick connect/release mechanism 76 includes two primary components, namely a shank 78 and a locking device 80. A bushing 82 is disposed within the opening 30 on the flange 26 and extends outwardly between the flange 26 and the locking device 80. Preferably, the bushing 82 is formed of a polymeric material to provide an appropriate wear surface for the locking device 80.

The shank 78 extends through the opening 30 in the body portion 24 and is adapted to be mounted to the beverage filling machine 22. Preferably, the shank 78 also extends through the bushing 82. The shank 78 has a proximal end with a series of threads 84 and has a distal end defining a ball 86. The beverage filling machine 22 includes pre-formed holes that define the position for the threaded proximal end of the shank 78. The shank 78 further includes a neck 88 disposed adjacent the ball 54. The shank 78 is illustrated as having a shaft-like configuration with a hex socket disposed within the ball 54. The shank 78 is installed onto the beverage filling machine 22 via the threads 84. It should be appreciated that the shank 78 may have any suitable configuration and is in no way limited to a shaft-like configuration. For example, the shank 78 may be arcuate or have a plate-like configuration.

A gage (not shown) can be utilized when the shank 78 is being installed onto the beverage filling machine 22. The gage ensures that the neck 88 and ball 54 of the shank 78 protrudes from the beverage filling machine 22 by a predetermined distance. This in turn ensures that the filling valve apparatus 15 will be properly installed.

As shown in FIGS. 1 and 11-13, the locking device 80 is coupled to the shank 78 with the locking device 80 having an unlocked position loosely connected to the shank 78 (FIG. 11) and a locked position with at least a portion of the locking device 80 wedged between the flange 26 and the shank 78 (FIGS. 1 and 13) for fixedly securing the filling valve apparatus 15 to the beverage filling machine 22. As shown in FIGS. 1, 4-7, and 11-13, the locking device 80 has a block-like configuration with a top, bottom, and a number of sides. The locking device 80 includes a caming surface 90 for applying a clamping force against the flange 26 when the locking device 80 is in the locked position. Preferably, the caming surface 90 engages the bushing 82 during the application of the clamping force. The locking device 80 includes a first lobe 92 defining the caming surface 90 for applying a progressive clamping force against the flange 26 as the locking device 80 moves from the unlocked position to the locked position. The locking device 80 also includes a second lobe 94 and a trough 96 disposed between the first 92 and second 94 lobes to further define the caming surface 90. Preferably, the first lobe 92 is substantially larger than the second lobe 94 and the first lobe 92 extends from the top of the locking device 80 to one of the sides of the locking device 80. The first lobe 92 engages the bushing 82 during the application of the clamping force (see FIG. 12). The second lobe 94 engages the bushing 82 when the locking device 80 is in the locked position (see FIG. 13). The second lobe 94 also provides a stop when in the locked position to securely lock the locking device 80 to the shank 78. Hence, the locking device 80 is disposed at a slight angle relative to the shank 78 when in the locked position, which creates a past center position for ensuring that the locking device 80 will not flop back to the unlocked position. Also, the larger first lobe 92 is configured in such a manner to ensure that the locking device 80 remains in the locked position until forcibly actuated out of the locked position.

The locking device 80 also includes an inner cavity 98 and a first opening 100 allowing access to the cavity 98 with the ball 54 disposed within the cavity 98 when the locking device 80 is coupled to the shank 78. The first opening 100 in the locking device 80 includes a slot 102 aligned with the neck 88 when the locking device 80 moves between the unlocked and locked positions. The first opening 100 in the locking device 80 further includes an enlarged aperture 104 in communication with the slot 102 with the enlarged aperture 104 complementary in size to the ball 54 such that the ball 54 can pass through the first opening 100 and into the cavity 98 to align the shank 78 with the slot 102. The slot 102 and enlarged opening 104 define a key hole shaped first opening 100 in the locking device 80 that is best shown in FIG. 5. The first opening 100 is also substantially U-shaped at the top of the locking device 80 as best shown in FIG. 7. The cavity 98 also has an interior curved surface complementary in configuration to the ball 54. At an opposing end of the interior curved surface of the locking device 80 is a second opening 106 allowing additional access to the cavity 98 with the second opening 106 being substantially transverse to the first opening 100. The second opening 106 is substantially circular as shown in FIG. 6.

Turning to FIGS. 8-14, the subject invention also includes a wrench assembly 108 for operationally manipulating the quick connect/release mechanism 76 as well as other parts of the filling valve apparatus 15. A preferred configuration of the wrench assembly 108 will be discussed in greater detail. However, it should be appreciated that the wrench assembly 108 may have any suitable configuration.

The wrench assembly 108 preferably has a handle or crank arm 110 with a first end 112 configured to engage the locking device 80 and has a second end 114 configured to engage the valve assemblies 68, 70. In particular, the first end 112 engages the locking device 80 to move the locking device 80 between the unlocked and locked positions and for removing the filling valve apparatus 15 from the beverage filling machine 22 and re-installing the filling valve apparatus 15 onto the beverage filling machine 22 when the beverage filling machine 22 is serviced. The first end 112 of the wrench assembly 108 further includes a projection 116 configured to engage the second opening 106 in the locking device 80 to couple the wrench assembly 108 to the locking device 80. Preferably, the projection 116 is substantially tubular to couple with the circular second opening 106.

The second end 114 of the wrench assembly 108 engages one of the valve assemblies 68, 70 for removing the valve assembly 68, 70 from the filling valve apparatus 15 and re-installing the valve assembly 68, 70 onto the filling valve apparatus 15. The second end 114 of the wrench assembly 108 preferably includes a socket 118 for at least partially encapsulating the valve assembly 68, 70 being removed or installed.

A first ratcheting mechanism 120 is disposed between the handle 110 and the projection 116 at the first end 112 of the wrench assembly 108 for allowing the projection 116 to pivot to any desired angle relative to the handle 110. Similarly, a second ratcheting mechanism 122 is disposed between the handle 110 and the socket 118 at the second end 114 of the wrench assembly 108 for allowing the socket 118 to pivot to any desired angle relative to the handle 110. Preferably, the ratcheting mechanisms 120, 122 are similar and each include a pawl 124 that engages and disengages a corresponding ratchet 126. Each pawl 124 pivots about a pin and includes a spring 128 for continuously biasing each pawl 124 toward a corresponding ratchet 126. A button 130 is provided on each pawl 124 for facilitating a release of the ratchet 126. It should be appreciated that the ratcheting mechanisms 120, 122 may be eliminated from the wrench assembly 108 without deviating from the overall scope of the subject invention.

The second end 114 of the wrench assembly 108 also includes a torque limiting device for ensuring that each of the valve assemblies 68, 70 are properly installed onto the filling valve apparatus 15. The torque limiting device includes a torque head 132 having a first set of teeth. The socket 118 includes a second set of teeth that cooperate with the first set of teeth. A spring 134 is disposed between the torque head 132 and the socket 118. A sleeve 136 is disposed about the torque head 132 and a portion of the socket 118. The socket 118 includes an aperture and the torque head 132 includes an inner bore. A bolt 138 passes through the aperture in the socket 118 and engages the inner bore of the torque head 132. The bolt 138 has a flange that captures the spring 134 such that the spring 128 is disposed between the bolt 138 and the socket 118. As such, the biasing force of the spring 134 reacts between the flange of the bolt 138 and the socket 118. The socket 118 can slide relative to the bolt 138, sleeve 136, and torque head 132 when the predetermined torque setting is overcome. The predetermined torque setting is achieved by the biasing force of the spring 134, the angle of the two sets of teeth, and the frictional forces between the teeth. The torque setting limits an amount of torque that can be applied during the installation of the valve assemblies 68, 70.

Figure 9:
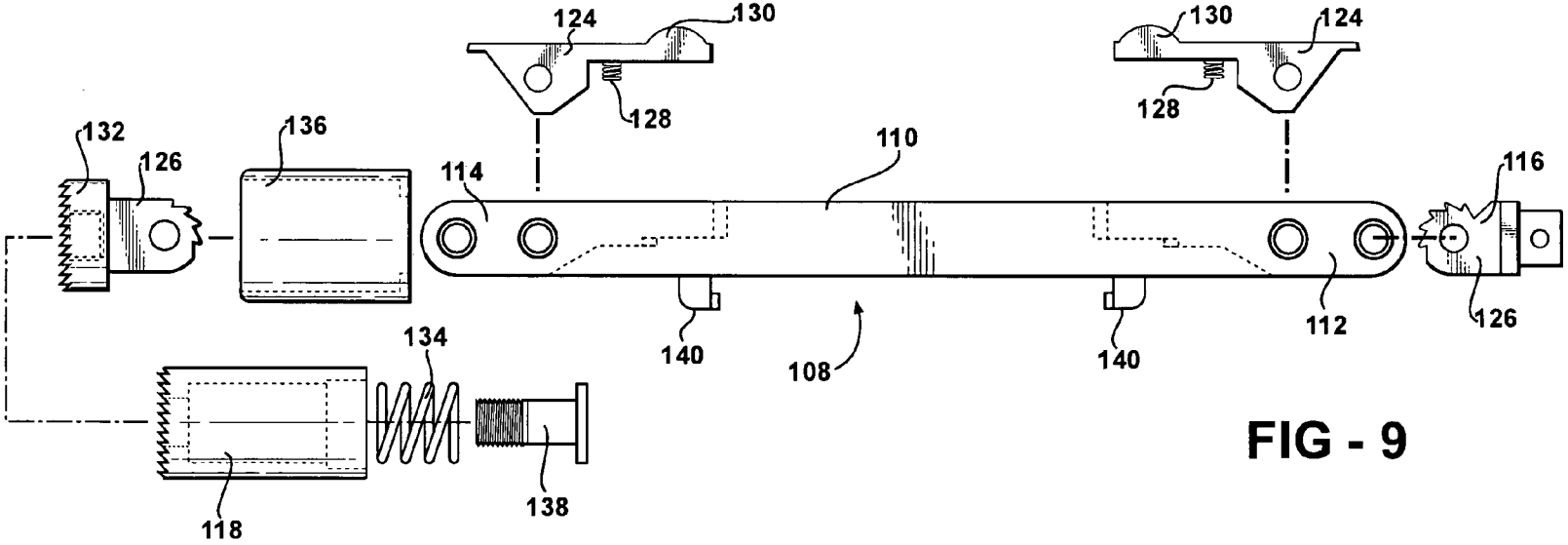
FIG. 9 is an exploded side view of the wrench assembly.
Figure 10:
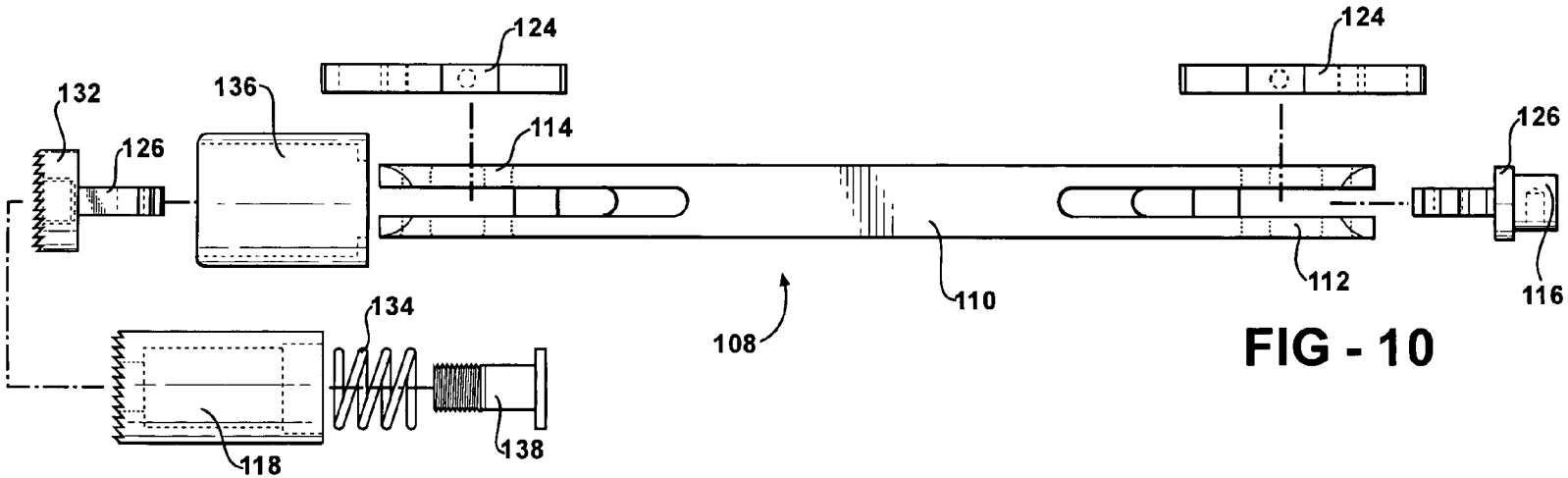
FIG. 10 is an exploded top view of the wrench assembly.
Figure 11:
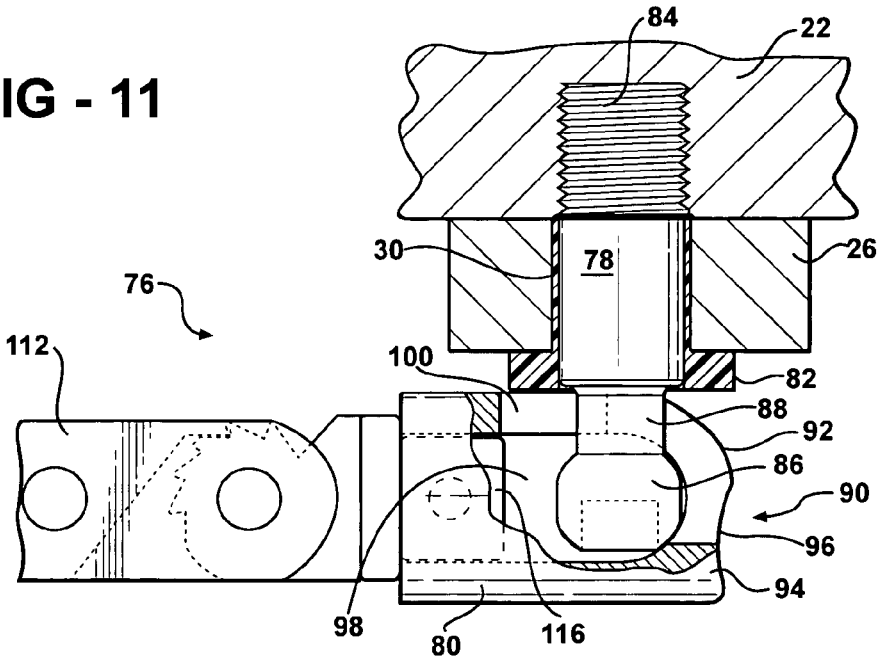
FIG. 11 is a partially cross-sectional side view of the wrench assembly engaging the locking device with the locking device in an unlocked position.
Figure 12:
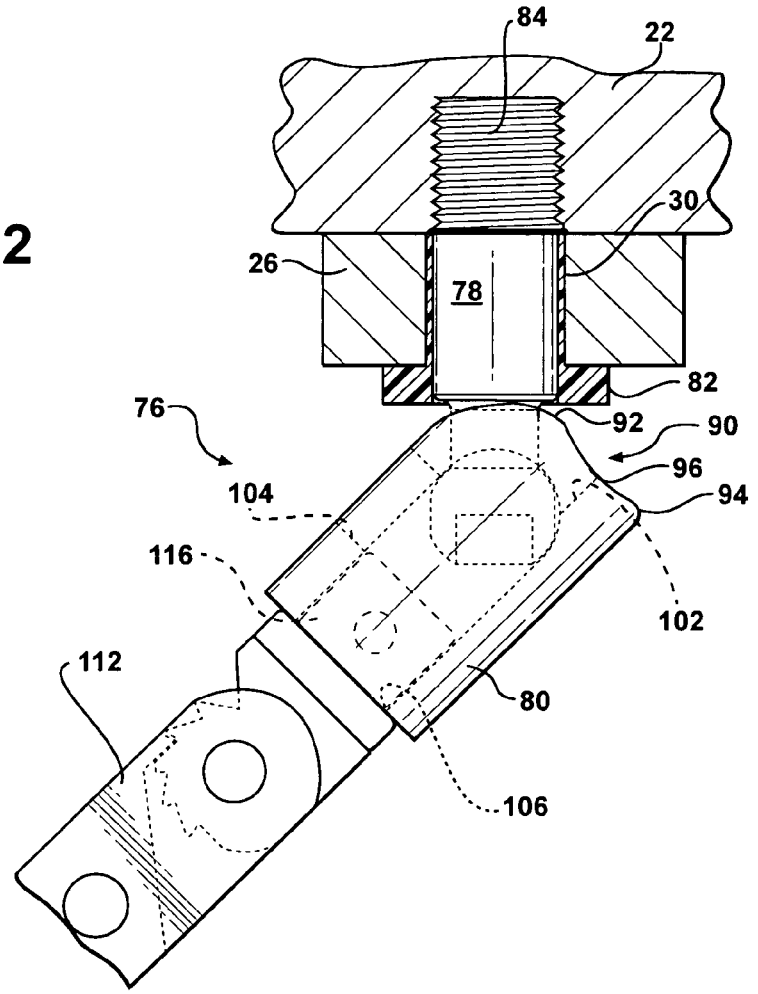
FIG. 12 is another partially cross-sectional side view of the wrench assembly engaging the locking device with the locking device in an intermediate position.
Figure 13:
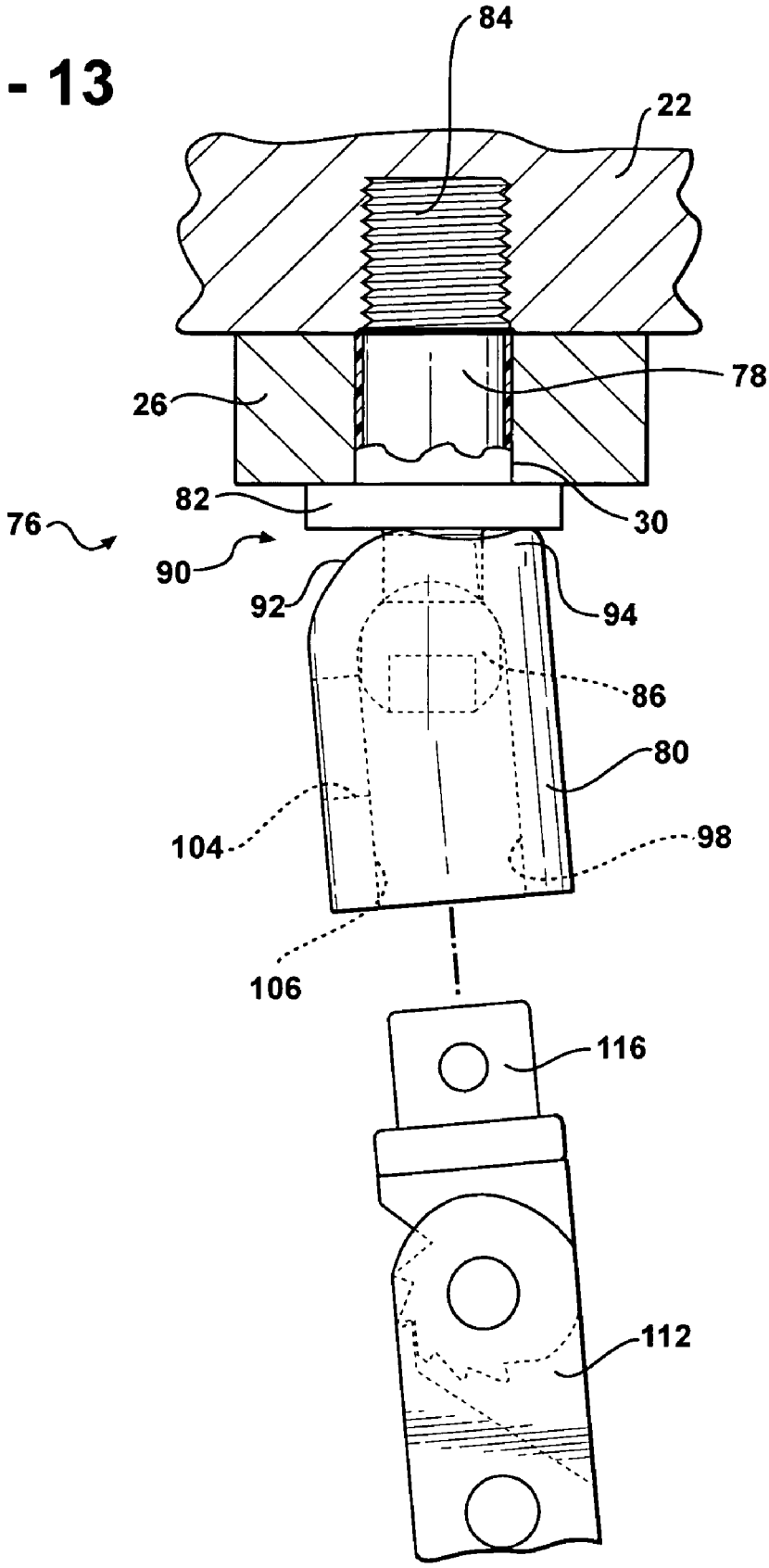
FIG. 13 is yet another partially cross-sectional side view of the wrench assembly engaging the locking device with the locking device in a locked position.
Figure 14:
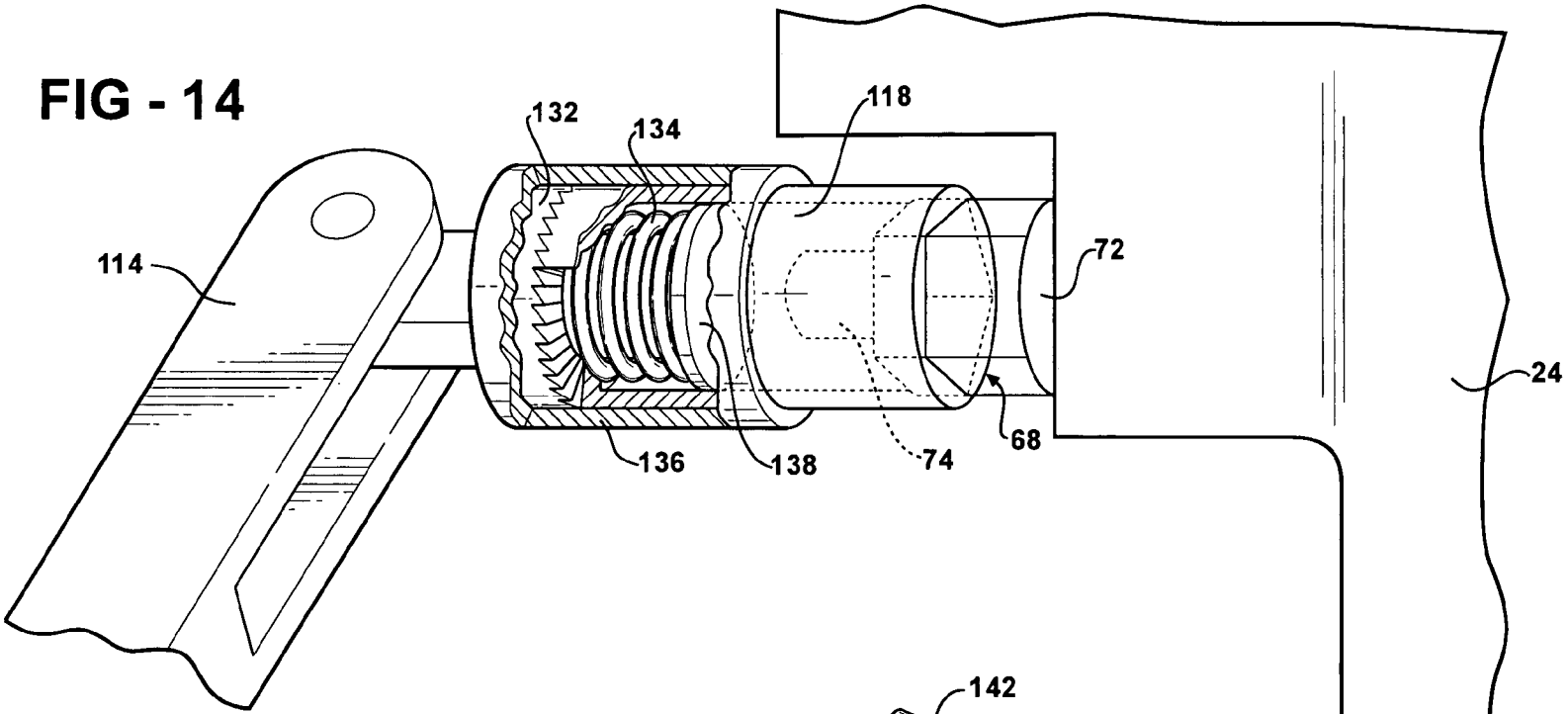
FIG. 14 is a partially cross-sectional perspective view of the wrench assembly engaging a valve assembly.
Figure 15:
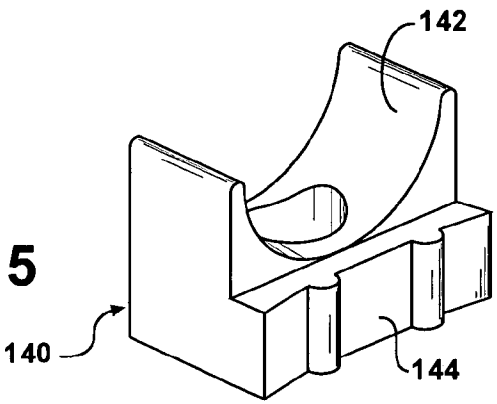
FIG. 15 is a perspective view of a gripper.

As shown in FIGS. 8, 9, and 15, the handle 110 of the wrench assembly 108 also includes a pair of grippers 140 extending from the handle 110 for engaging a portion of the filling valve apparatus 15. Preferably, the grippers 140 engage the valve bell 46 for removing and re-installing the valve bell 46 onto the filling valve apparatus 15. Alternatively, there may be dimples or other indentations in the valve bell 46 (not shown) to assist in gripping the valve bell 46 with the wrench assembly 108. The grippers 140 each include a base 142 mounted to the handle 110 and a contact surface 144 for engaging the valve bell 46. The contact surface 144 preferably has ridges and is preferably formed of a rubber-like material to adequately grip the valve bell 46.

The shank 78, locking device 80, and wrench assembly 108 form a servicing kit for servicing the filling valve apparatus 15 of the beverage filling machine 22. The servicing kit also includes at least the valve assemblies 68, 70, bushings 82, cartridge assembly 62, and various seals 44, 48, 56, 58. The valve assemblies 68, 70, bushings 82, cartridge assembly 62, and seals 44, 48, 56, 58 are replaced on the filling valve apparatus 15 during a servicing of the filling valve apparatus 15. The seals 44, 48, 56, 58 can include the ring seal 44, container seal 48, ball cage seal 56, and the seal 58 in the flange 26. It should be appreciated that fewer or more seals may be replaced during servicing without deviating from the scope of the subject invention. The valve assemblies 68, 70 can include both the snift valve assembly 68 and the purge valve assembly 70. The servicing kit can also include the ball 54 for the ball cage 52 and the bushings 82. The servicing kit provides an all-in-one kit for performing a maintenance of the filling valve apparatus 15.

The servicing operation of the filling valve apparatus 15 is greatly improved through the development of the subject invention. The filling valve apparatus 15 is first quickly and easily removed from the beverage filling machine 22 through the use of the quick connect/release mechanism 76. In particular, the projection 116 on the first end 112 of the wrench assembly 108 is inserted into the second opening 106 in the locking device 80 (see FIG. 13). The locking device 80 is then manipulated by rotationally moving the locking device 80 relative to the shank 78 (see FIG. 12). As is appreciated, the first ratcheting mechanism 120 may be utilized to move the handle 110 of the wrench assembly 108 relative to the projection 116 to provide additional leverage during the manipulation of the locking device 80. The wrench assembly 108 continues to move the locking device 80 to the unlocked position (see FIG. 11). The locking device 80 can then be removed from the shank 78 by sliding the locking device 80 relative to the shank 78 until the ball 86 aligns with the enlarged aperture 104. The locking device 80 is then pulled off of the shank 78 and the filling valve apparatus 15 can be removed. Once removed, the bushings 82 can be inspected and replaced.

The cartridge assembly 62 is now accessible and can be replaced. In particular, the cartridge assembly 62 is removed as a single unit and replaced with a new cartridge assembly 62, as a single unit. The snift 68 and purge 70 valve assemblies are also removed as single units and replaced with new snift 68 and purge 70 valve assemblies in simplified and single steps. In particular, the socket 118 on the second end 114 of the wrench assembly 108 at least partially encapsulates the housing 72 of the valve assembly 68, 70 to be removed. The handle 110 can then be rotated to unscrew the valve assembly 68, 70 from the body portion 24 of the filling valve apparatus 15. The second ratcheting mechanism 122 may be utilized to move the handle 110 of the wrench assembly 108 relative to the socket 118 to provide additional leverage during the manipulation of the valve assembly 68, 70. The teeth are angled in such a manner that the socket 118 and torque head 132 will not move relative to each other. In other words, the torque limiting device is not operational during the removal of the valve assembly 68, 70. Once removed, a new valve assembly 68, 70 is positioned into the socket 118. The handle 110 is again rotated, in an opposite direction, to install the valve assembly 68, 70. Once the predetermined position of the valve assembly 68, 70 is reached, the torque limiting device automatically activates, which ensures that the valve assembly 68, 70 is not over tightened. The activation of the torque limiting device occurs when the force applied to the handle 110 is greater than the frictional force between the teeth and the force of the spring 128.

The grippers 140 of the wrench assembly 108 can now engage the valve bell 46 to rotate the valve bell 46 relative to the body portion 24. In particular, the handle 110 will be positioned sideways relative to the valve bell 46 and the contact surface 144 will engage the valve bell 46. Upon removal of the valve bell 46, the ring seal 44 and container seal 48 can be replaced. The valve bell 46 is then re-installed and tightened through the use of the wrench assembly 108.

The unitary nature of the cartridge 62 and valve 68, 70 assemblies ensures that all of the working components are replaced, which in turn equates to reliable and consistent maintenance of the filling valve apparatuses 15. The unitary nature of the wrench assembly 108 ensures that virtually every step in the maintenance process can be completed without any additional tools. Additional components, such as the ball 54 for the ball cage 52 and other seals 56, 58 may also be quickly removed and reinstalled with new parts. The filling valve assembly is then reinstalled about the shanks 78 on the beverage filling machine 22. The locking devices 80 are returned to the shanks 78 and the operation of the quick connect/release mechanism 76 is now performed in reverse. The entire servicing of the filling valve is now complete.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed is:

1. A filling valve apparatus of a beverage filling machine for filling a container with a fluid, said apparatus comprising:

a body portion having a flange fixed relative to said body portion with at least one opening disposed within said flange and said body portion defining a cavity with at least one aperture for directing the fluid into the container;

a shank extending through said opening in said body portion and adapted to be mounted to the beverage filling machine;

said apparatus characterized by a locking device coupled to said shank with said locking device having an unlocked position loosely connected to said shank and a locked position with at least a portion of said locking device wedged between said flange and said shank for fixedly securing said filling valve apparatus to the beverage filling machine.

2. An apparatus as set forth in claim 1 wherein said locking device includes a caming surface for applying a clamping force against said flange when said locking device is in said locked position.

3. An apparatus as set forth in claim 2 further including a bushing disposed between said flange and said locking device with said caming surface engaging said bushing during said application of said clamping force.

4. An apparatus as set forth in claim 2 wherein said locking device includes a first lobe defining said caming surface for applying a progressive clamping force against said flange as said locking device moves from said unlocked position to said locked position.

5. An apparatus as set forth in claim 4 wherein said locking device includes a second lobe and a trough disposed between said first and second lobes to further define said caming surface.

6. An apparatus as set forth in claim 5 wherein said first lobe is substantially larger than said second lobe and said first lobe extends from a top of said locking device to a side of said locking device.

7. An apparatus as set forth in claim 5 further including a bushing disposed between said flange and said locking device with said first lobe engaging said bushing during said application of said clamping force and said second lobe engaging said bushing when said locking device is in said locked position to define a stop and to securely lock said locking device to said shank.

8. An apparatus as set forth in claim 7 wherein said bushing is formed of a polymeric material.

9. An apparatus as set forth in claim 1 wherein said shank has a distal end defining a ball.

10. An apparatus as set forth in claim 9 wherein said locking device includes an inner cavity and a first opening allowing access to said cavity with said ball disposed within said cavity when said locking device is coupled to said shank.

11. An apparatus as set forth in claim 10 wherein said shank further includes a neck disposed adjacent said ball and said first opening in said locking device includes a slot aligned with said neck when said locking device moves between said unlocked and locked positions.

12. An apparatus as set forth in claim 11 wherein said first opening in said locking device further includes an enlarged aperture in communication with said slot with said enlarged aperture complementary in size to said ball such that said ball can pass through said opening and into said cavity to align said shank with said slot.

13. An apparatus as set forth in claim 12 wherein said locking device includes a second opening allowing additional access to said cavity with said second opening being substantially transverse to said first opening.

14. An apparatus as set forth in claim 1 further including a stem mounted to said body portion within said cavity and defining a longitudinal passageway extending out of said body portion.

15. An apparatus as set forth in claim 14 further including a sleeve disposed over said stem and having a top and a bottom with said bottom extending into said cavity of said body portion.

16. An apparatus as set forth in claim 15 further including a seal mounted to said bottom of said sleeve for sealing said aperture of said body portion and preventing fluid from flowing through said aperture of said body portion.

17. An apparatus as set forth in claim 1 wherein said flange is integral to said body portion.

* * * * *